US009285084B2

(12) United States Patent
Amrine, Jr. et al.

(10) Patent No.: US 9,285,084 B2
(45) Date of Patent: Mar. 15, 2016

(54) DIFFUSERS FOR LED-BASED LIGHTS

(71) Applicant: iLumisys, Inc., Troy, MI (US)

(72) Inventors: James Meredith Amrine, Jr., Ann Arbor, MI (US); Allan Brent York, Langley (CA)

(73) Assignee: iLumisys, Inc., Troy, MI (US)

( * ) Notice: Subject to any disclaimer, the term of this patent is extended or adjusted under 35 U.S.C. 154(b) by 41 days.

(21) Appl. No.: 14/208,403

(22) Filed: Mar. 13, 2014

(65) Prior Publication Data

US 2014/0268727 A1 Sep. 18, 2014

Related U.S. Application Data

(60) Provisional application No. 61/783,217, filed on Mar. 14, 2013, provisional application No. 61/846,712, filed on Jul. 16, 2013.

(51) Int. Cl.

| | |
|---|---|
| ***F21V 5/04*** | (2006.01) |
| ***F21S 4/00*** | (2006.01) |
| ***F21K 99/00*** | (2010.01) |

(Continued)

(52) U.S. Cl.

CPC ... *F21K 9/17* (2013.01); *F21V 3/02* (2013.01); *F21V 17/04* (2013.01); *F21K 9/50* (2013.01); *F21V 3/049* (2013.01); *F21V 19/004* (2013.01); *F21Y 2101/02* (2013.01); *F21Y 2103/003* (2013.01)

(58) Field of Classification Search

CPC ..... F21Y 2101/02; F21Y 2103/003; F21V 5/008; F21V 5/043; F21V 17/002; F21V 17/06; F21V 17/16; F21V 17/164

USPC ..... 362/268, 217.02, 223, 225

See application file for complete search history.

(56) References Cited

U.S. PATENT DOCUMENTS

| | | | |
|---|---|---|---|
| D54,511 | S | 2/1920 | Owen |
| D58,105 | S | 6/1921 | Poritz |

(Continued)

FOREIGN PATENT DOCUMENTS

| | | | |
|---|---|---|---|
| CN | 1584388 | A | 2/2005 |
| CN | 2766345 | Y | 3/2006 |

(Continued)

OTHER PUBLICATIONS

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.

(Continued)

*Primary Examiner* — Peggy Neils

(74) *Attorney, Agent, or Firm* — Young, Basile, Hanlon & MacFarlane

(57) ABSTRACT

An LED-based light assembly includes a plurality of LEDs and an elongate housing for the LEDs. The housing has an outer surface at least partially defined by a first lens. The assembly also includes a second lens. The second lens is removably attachable to the outer surface of the housing such that at least a portion of the second lens overlays the first lens in a spaced relationship. The assembly further includes at least one connector arranged at an end of the housing that configured for engagement with a socket of a fluorescent light fixture.

11 Claims, 6 Drawing Sheets

(51) Int. Cl.

| | |
|---|---|
| ***F21V 3/02*** | (2006.01) |
| ***F21V 17/04*** | (2006.01) |
| *F21V 3/04* | (2006.01) |
| *F21V 19/00* | (2006.01) |
| *F21Y 101/02* | (2006.01) |
| *F21Y 103/00* | (2006.01) |

(56) References Cited

U.S. PATENT DOCUMENTS

| | | | |
|---|---|---|---|
| D79,814 | S | 11/1929 | Hoch |
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenberg |
| 2,909,097 | A | 10/1959 | Alden et al. |
| 3,178,622 | A | 4/1965 | Paul et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,821,590 | A | 6/1974 | Kosman et al. |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,009,394 | A | 2/1977 | Mierzwinski |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,257,672 | A | 3/1981 | Balliet |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,650,971 | A | 3/1987 | Manecci et al. |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,727,457 | A | 2/1988 | Thillays |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,767,172 | A | 8/1988 | Hubble, III et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,847,536 | A | 7/1989 | Lowe et al. |
| 4,851,972 | A | 7/1989 | Atlman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,920,459 | A | 4/1990 | Rothwell et al. |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,001,609 | A | 3/1991 | Gardner et al. |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |

(56) References Cited

U.S. PATENT DOCUMENTS 5,034,807 A 7/1991 Von Kohorn
5,036,248 A 7/1991 McEwan et al.
5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,761 A 7/1992 Tanaka
5,130,909 A 7/1992 Gross
5,134,387 A 7/1992 Smith et al.
5,136,483 A 8/1992 Schnogier et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,268,828 A 12/1993 Miura
5,278,542 A 1/1994 Smith et al.
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Sieb
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,639,158 A 6/1997 Sato
5,640,061 A 6/1997 Bornhorst et al.
5,640,141 A 6/1997 Myllymaki
5,640,792 A 6/1997 O'Shea et al.
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,690,417 A 11/1997 Choate et al.
5,697,695 A 12/1997 Lin et al.
5,699,243 A 12/1997 Eckel et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,848,837 A 12/1998 Gustafson
5,850,126 A 12/1998 Kanbar

(56) References Cited

U.S. PATENT DOCUMENTS 5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,870,233 A 2/1999 Benz et al.
5,890,794 A 4/1999 Abtahi et al.
5,893,633 A 4/1999 Saito et al.
5,896,010 A 4/1999 Mikolajczak et al.
5,904,415 A 5/1999 Robertson et al.
5,907,742 A 5/1999 Johnson et al.
5,909,378 A 6/1999 De Milleville
5,912,653 A 6/1999 Fitch
5,917,287 A 6/1999 Haederle et al.
5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
6,031,958 A 2/2000 McGaffigan
6,036,335 A 3/2000 Openiano
6,036,336 A 3/2000 Wu
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,115,184 A 9/2000 Hubble, III et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,234,645 B1 5/2001 Börner et al.
6,238,075 B1 5/2001 Dealey, Jr. et al.
6,240,665 B1 6/2001 Brown et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
6,380,865 B1 4/2002 Pederson
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.

(56) References Cited

U.S. PATENT DOCUMENTS 6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
D477,093 S 7/2003 Moriyama et al.
6,585,393 B1 7/2003 Brandes et al.
6,586,890 B2 7/2003 Min et al.
6,590,343 B2 7/2003 Pederson
6,592,238 B2 7/2003 Cleaver et al.
6,594,369 B1 7/2003 Une
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,609,813 B1 8/2003 Showers et al.
6,612,712 B2 9/2003 Nepil
6,612,717 B2 9/2003 Yen
6,612,729 B1 9/2003 Hoffman
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,525 B2 5/2004 Chin
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
D506,274 S 6/2005 Moriyama et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,029,145 B2 4/2006 Frederick
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.

(56) References Cited

U.S. PATENT DOCUMENTS 7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich et al.
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,262,559 B2 8/2007 Tripathi et al.
D550,379 S 9/2007 Hoshikawa et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
7,274,183 B1 9/2007 Gu et al.
D553,267 S 10/2007 Yuen
7,285,801 B2 10/2007 Eliashevich et al.
7,288,902 B1 10/2007 Melanson
7,288,904 B2 10/2007 Numeroli et al.
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,024 B2 2/2008 Lynch et al.
7,329,031 B2 2/2008 Liaw et al.
D563,589 S 3/2008 Hariri et al.
7,344,278 B2 3/2008 Paravantsos
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,370,986 B2 5/2008 Chan
7,374,327 B2 5/2008 Schexnaider
7,378,805 B2 5/2008 Oh et al.
7,378,976 B1 5/2008 Paterno
7,385,359 B2 6/2008 Dowling et al.
7,391,159 B2 6/2008 Harwood
D574,093 S 7/2008 Kitagawa et al.
7,396,142 B2 7/2008 Laizure, Jr. et al.
7,396,146 B2 7/2008 Wang
7,401,935 B2 7/2008 VanderSchuit
7,401,945 B2 7/2008 Zhang
D576,749 S 9/2008 Kitagawa et al.
7,423,548 B2 9/2008 Kontovich
7,427,840 B2 9/2008 Morgan et al.
7,429,117 B2 9/2008 Pohlert et al.
7,434,964 B1 10/2008 Zheng et al.
7,438,441 B2 10/2008 Sun et al.
D580,089 S 11/2008 Ly et al.
D581,556 S 11/2008 To et al.
7,449,847 B2 11/2008 Schanberger et al.
D582,577 S 12/2008 Yuen
7,466,082 B1 12/2008 Synder et al.
7,470,046 B2 12/2008 Kao et al.
D584,428 S 1/2009 Li et al.
D584,429 S 1/2009 Pei et al.

(56) References Cited

U.S. PATENT DOCUMENTS 7,476,002 B2 1/2009 Wolf et al.
7,476,004 B2 1/2009 Chan
7,478,924 B2 1/2009 Robertson
7,482,764 B2 1/2009 Morgan et al.
D586,484 S 2/2009 Liu et al.
D586,928 S 2/2009 Liu et al.
7,490,957 B2 2/2009 Leong et al.
7,497,596 B2 3/2009 Ge
7,498,753 B2 3/2009 McAvoy et al.
7,507,001 B2 3/2009 Kit
7,510,299 B2 3/2009 Timmermans et al.
7,510,400 B2 3/2009 Glovatsky et al.
7,514,876 B2 4/2009 Roach, Jr.
7,520,635 B2 4/2009 Wolf et al.
7,521,872 B2 4/2009 Bruning
7,524,089 B2 4/2009 Park
D592,766 S 5/2009 Zhu et al.
D593,223 S 5/2009 Komar
7,530,701 B2 5/2009 Chan-Wing
7,534,002 B2 5/2009 Yamaguchi et al.
D594,999 S 6/2009 Uchida et al.
7,549,769 B2 6/2009 Kim et al.
7,556,396 B2 7/2009 Kuo et al.
7,559,663 B2 7/2009 Wong et al.
7,562,998 B1 7/2009 Yen
D597,686 S 8/2009 Noh
7,569,981 B1 8/2009 Ciancanelli
7,572,030 B2 8/2009 Booth et al.
7,575,339 B2 8/2009 Hung
7,579,786 B2 8/2009 Soos
7,583,035 B2 9/2009 Shteynberg et al.
7,583,901 B2 9/2009 Nakagawa et al.
7,594,738 B1 9/2009 Lin et al.
D601,726 S 10/2009 Mollaert et al.
7,598,681 B2 10/2009 Lys et al.
7,598,684 B2 10/2009 Lys et al.
7,598,686 B2 10/2009 Lys et al.
7,600,907 B2 10/2009 Liu et al.
7,602,559 B2 10/2009 Jang et al.
7,618,157 B1 11/2009 Galvez et al.
7,619,366 B2 11/2009 Diederiks
7,635,201 B2 12/2009 Deng
7,635,214 B2 12/2009 Perlo
7,639,517 B2 12/2009 Zhou et al.
7,648,251 B2 1/2010 Whitehouse et al.
7,649,327 B2 1/2010 Peng
D610,724 S 2/2010 Chiang et al.
7,654,703 B2 * 2/2010 Kan et al. ..... 362/362
7,661,839 B2 2/2010 Tsai
D612,528 S 3/2010 McGrath et al.
7,690,813 B2 4/2010 Kanamori et al.
7,710,047 B2 5/2010 Shteynberg et al.
7,710,253 B1 5/2010 Fredricks
7,712,918 B2 5/2010 Siemiet et al.
7,748,886 B2 7/2010 Pazula et al.
7,758,207 B1 7/2010 Zhou et al.
7,759,881 B1 7/2010 Melanson
D621,975 S 8/2010 Wang
7,784,966 B2 8/2010 Verfuerth et al.
7,800,511 B1 9/2010 Hutchison et al.
7,815,338 B2 10/2010 Siemiet et al.
7,815,341 B2 10/2010 Steedly et al.
7,828,471 B2 11/2010 Lin
7,843,150 B2 11/2010 Wang et al.
7,848,702 B2 12/2010 Ho et al.
7,850,341 B2 12/2010 Mrakovich et al.
RE42,161 E 2/2011 Hochstein
7,878,683 B2 2/2011 Logan et al.
7,887,216 B2 2/2011 Patrick
7,887,226 B2 2/2011 Huang et al.
7,889,051 B1 2/2011 Billig et al.
D634,452 S 3/2011 de Visser
7,926,975 B2 4/2011 Siemiet et al.
7,938,562 B2 5/2011 Ivey et al.
7,946,729 B2 5/2011 Ivey et al.
7,952,292 B2 5/2011 Vegter et al.
7,976,196 B2 7/2011 Ivey et al.
7,990,070 B2 8/2011 Nerone
7,997,770 B1 8/2011 Meurer
8,013,472 B2 9/2011 Adest et al.
D650,097 S 12/2011 Trumble et al.
D650,494 S 12/2011 Tsao et al.
D652,968 S 1/2012 Aguiar et al.
8,093,823 B1 1/2012 Ivey et al.
D654,192 S 2/2012 Maxik et al.
8,118,447 B2 2/2012 Simon et al.
8,147,091 B2 4/2012 Hsia et al.
8,159,152 B1 4/2012 Salessi
D660,472 S 5/2012 Aguiar et al.
8,167,452 B2 5/2012 Chou
8,177,388 B2 5/2012 Yen
8,179,037 B2 5/2012 Chen et al.
8,183,989 B2 5/2012 Tsai
D662,236 S 6/2012 Matsushita
8,203,445 B2 6/2012 Recker et al.
8,214,084 B2 7/2012 Ivey et al.
8,247,985 B2 8/2012 Timmermans et al.
8,251,544 B2 8/2012 Ivey et al.
8,262,249 B2 9/2012 Hsia et al.
8,272,764 B2 9/2012 Son
8,287,144 B2 10/2012 Pedersen et al.
8,297,788 B2 10/2012 Bishop
8,299,722 B2 10/2012 Melanson
8,304,993 B2 11/2012 Tzou et al.
8,313,213 B2 11/2012 Lin et al.
8,319,407 B2 11/2012 Ke
8,319,433 B2 11/2012 Lin et al.
8,319,437 B2 11/2012 Carlin et al.
8,322,878 B2 12/2012 Hsia et al.
8,324,817 B2 12/2012 Ivey et al.
8,337,071 B2 12/2012 Negley et al.
8,366,291 B2 * 2/2013 Hoffmann ..... 362/222
8,376,579 B2 2/2013 Chang
8,376,588 B2 2/2013 Yen
8,382,322 B2 2/2013 Bishop
8,382,327 B2 2/2013 Timmermans et al.
8,382,502 B2 2/2013 Cao et al.
8,388,179 B2 3/2013 Hood et al.
8,398,275 B2 3/2013 Wang et al.
8,403,692 B2 3/2013 Cao et al.
8,405,314 B2 3/2013 Jensen
8,434,914 B2 5/2013 Li et al.
8,454,193 B2 6/2013 Simon et al.
8,482,212 B1 7/2013 Ivey et al.
8,571,716 B2 10/2013 Ivey et al.
9,016,895 B2 * 4/2015 Handsaker ..... 362/235
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0041159 A1 4/2002 Kaping
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.

(56) References Cited

U.S. PATENT DOCUMENTS

2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0166634 A1 8/2005 Lieberman et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Chaeng et al.
2005/0243577 A1 11/2005 Moon
2005/0248299 A1 11/2005 Chemel et al.
2005/0253533 A1 11/2005 Lys et al.
2005/0259424 A1 11/2005 Zampini, II et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0091826 A1 5/2006 Chen
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.

(56) References Cited

U.S. PATENT DOCUMENTS

| | | | |
|---|---|---|---|
| 2006/0215422 | A1 | 9/2006 | Laizure, Jr. et al. |
| 2006/0220595 | A1 | 10/2006 | Lu |
| 2006/0221606 | A1 | 10/2006 | Dowling et al. |
| 2006/0221619 | A1 | 10/2006 | Nishigaki |
| 2006/0227558 | A1 | 10/2006 | Osawa et al. |
| 2006/0232974 | A1 | 10/2006 | Lee et al. |
| 2006/0238884 | A1 | 10/2006 | Jang et al. |
| 2006/0262516 | A9 | 11/2006 | Dowling et al. |
| 2006/0262521 | A1 | 11/2006 | Piepgras et al. |
| 2006/0262544 | A1 | 11/2006 | Piepgras et al. |
| 2006/0262545 | A1 | 11/2006 | Piepgras et al. |
| 2006/0265921 | A1 | 11/2006 | Korall et al. |
| 2006/0273741 | A1 | 12/2006 | Stalker, III |
| 2006/0274529 | A1 | 12/2006 | Cao |
| 2006/0285325 | A1 | 12/2006 | Ducharme et al. |
| 2007/0035255 | A1 | 2/2007 | Shuster et al. |
| 2007/0035538 | A1 | 2/2007 | Garcia et al. |
| 2007/0035965 | A1 | 2/2007 | Holst |
| 2007/0040516 | A1 | 2/2007 | Chen |
| 2007/0041220 | A1 | 2/2007 | Lynch |
| 2007/0047227 | A1 | 3/2007 | Ducharme |
| 2007/0053182 | A1 | 3/2007 | Robertson |
| 2007/0053208 | A1 | 3/2007 | Justel et al. |
| 2007/0064419 | A1 | 3/2007 | Gandhi |
| 2007/0064425 | A1 | 3/2007 | Frecska et al. |
| 2007/0070621 | A1 | 3/2007 | Rivas et al. |
| 2007/0070631 | A1 | 3/2007 | Huang et al. |
| 2007/0081423 | A1 | 4/2007 | Chien |
| 2007/0086754 | A1 | 4/2007 | Lys et al. |
| 2007/0086912 | A1 | 4/2007 | Dowling et al. |
| 2007/0097678 | A1 | 5/2007 | Yang |
| 2007/0109763 | A1 | 5/2007 | Wolf et al. |
| 2007/0115658 | A1 | 5/2007 | Mueller et al. |
| 2007/0115665 | A1 | 5/2007 | Mueller et al. |
| 2007/0120463 | A1 | 5/2007 | Hayashi et al. |
| 2007/0120594 | A1 | 5/2007 | Balakrishnan et al. |
| 2007/0127234 | A1 | 6/2007 | Jervey, III |
| 2007/0133202 | A1 | 6/2007 | Huang et al. |
| 2007/0139938 | A1 | 6/2007 | Petroski et al. |
| 2007/0145915 | A1 | 6/2007 | Roberge et al. |
| 2007/0146126 | A1 | 6/2007 | Wang |
| 2007/0147046 | A1 | 6/2007 | Arik et al. |
| 2007/0152797 | A1 | 7/2007 | Chemel et al. |
| 2007/0152808 | A1 | 7/2007 | LaCasse |
| 2007/0153514 | A1 | 7/2007 | Dowling et al. |
| 2007/0159828 | A1 | 7/2007 | Wang |
| 2007/0165402 | A1 | 7/2007 | Weaver, Jr. et al. |
| 2007/0165405 | A1 | 7/2007 | Chen |
| 2007/0173978 | A1 | 7/2007 | Fein et al. |
| 2007/0177382 | A1 | 8/2007 | Pritchard et al. |
| 2007/0182387 | A1 | 8/2007 | Weirich |
| 2007/0188114 | A1 | 8/2007 | Lys et al. |
| 2007/0189026 | A1 | 8/2007 | Chemel et al. |
| 2007/0195526 | A1 | 8/2007 | Dowling et al. |
| 2007/0195527 | A1 | 8/2007 | Russell |
| 2007/0195532 | A1 | 8/2007 | Reisenauer et al. |
| 2007/0200725 | A1 | 8/2007 | Fredericks et al. |
| 2007/0205712 | A1 | 9/2007 | Radkov et al. |
| 2007/0206375 | A1 | 9/2007 | Piepgras et al. |
| 2007/0211461 | A1 | 9/2007 | Harwood |
| 2007/0211463 | A1 | 9/2007 | Chevalier et al. |
| 2007/0228999 | A1 | 10/2007 | Kit |
| 2007/0235751 | A1 | 10/2007 | Radkov et al. |
| 2007/0236156 | A1 | 10/2007 | Lys et al. |
| 2007/0236358 | A1 | 10/2007 | Street et al. |
| 2007/0237284 | A1 | 10/2007 | Lys et al. |
| 2007/0240346 | A1 | 10/2007 | Li et al. |
| 2007/0241657 | A1 | 10/2007 | Radkov et al. |
| 2007/0242466 | A1 | 10/2007 | Wu et al. |
| 2007/0247450 | A1 | 10/2007 | Lee |
| 2007/0247842 | A1 | 10/2007 | Zampini et al. |
| 2007/0247847 | A1 | 10/2007 | Villard |
| 2007/0247851 | A1 | 10/2007 | Villard |
| 2007/0252161 | A1 | 11/2007 | Meis et al. |
| 2007/0258231 | A1 | 11/2007 | Koerner et al. |
| 2007/0258240 | A1 | 11/2007 | Ducharme et al. |
| 2007/0263379 | A1 | 11/2007 | Dowling |
| 2007/0274070 | A1 | 11/2007 | Wedell |
| 2007/0281520 | A1 | 12/2007 | Insalaco et al. |
| 2007/0285926 | A1 | 12/2007 | Maxik |
| 2007/0285933 | A1 | 12/2007 | Southard et al. |
| 2007/0290625 | A1 | 12/2007 | He et al. |
| 2007/0291483 | A1 | 12/2007 | Lys |
| 2007/0296350 | A1 | 12/2007 | Maxik et al. |
| 2008/0003664 | A1 | 1/2008 | Tysoe et al. |
| 2008/0007945 | A1 | 1/2008 | Kelly et al. |
| 2008/0012502 | A1 | 1/2008 | Lys |
| 2008/0012506 | A1 | 1/2008 | Mueller et al. |
| 2008/0013316 | A1 | 1/2008 | Chiang |
| 2008/0013324 | A1 | 1/2008 | Yu |
| 2008/0018261 | A1 | 1/2008 | Kastner |
| 2008/0024067 | A1 | 1/2008 | Ishibashi |
| 2008/0029720 | A1 | 2/2008 | Li |
| 2008/0037226 | A1 | 2/2008 | Shin et al. |
| 2008/0037245 | A1 | 2/2008 | Chan |
| 2008/0037284 | A1 | 2/2008 | Rudisill |
| 2008/0049434 | A1 | 2/2008 | Marsh |
| 2008/0055894 | A1 | 3/2008 | Deng |
| 2008/0062680 | A1 | 3/2008 | Timmermans et al. |
| 2008/0068838 | A1 | 3/2008 | Galke et al. |
| 2008/0068839 | A1 | 3/2008 | Matheson |
| 2008/0074872 | A1 | 3/2008 | Panotopoulos |
| 2008/0089075 | A1 | 4/2008 | Hsu |
| 2008/0092800 | A1 | 4/2008 | Smith et al. |
| 2008/0093615 | A1 | 4/2008 | Lin et al. |
| 2008/0093998 | A1 | 4/2008 | Dennery et al. |
| 2008/0094819 | A1 | 4/2008 | Vaish |
| 2008/0094837 | A1 | 4/2008 | Dobbins et al. |
| 2008/0129211 | A1 | 6/2008 | Lin et al. |
| 2008/0130267 | A1 | 6/2008 | Dowling et al. |
| 2008/0150444 | A1 | 6/2008 | Usui et al. |
| 2008/0151535 | A1 | 6/2008 | de Castris |
| 2008/0158871 | A1 | 7/2008 | McAvoy et al. |
| 2008/0158887 | A1 | 7/2008 | Zhu et al. |
| 2008/0164826 | A1 | 7/2008 | Lys |
| 2008/0164827 | A1 | 7/2008 | Lys |
| 2008/0164854 | A1 | 7/2008 | Lys |
| 2008/0175003 | A1 | 7/2008 | Tsou et al. |
| 2008/0180036 | A1 | 7/2008 | Garrity et al. |
| 2008/0185961 | A1 | 8/2008 | Hong |
| 2008/0186704 | A1 | 8/2008 | Chou et al. |
| 2008/0192436 | A1 | 8/2008 | Peng et al. |
| 2008/0198598 | A1 | 8/2008 | Ward |
| 2008/0211386 | A1 | 9/2008 | Choi et al. |
| 2008/0211419 | A1 | 9/2008 | Garrity |
| 2008/0218993 | A1 | 9/2008 | Li |
| 2008/0224629 | A1 | 9/2008 | Melanson |
| 2008/0224636 | A1 | 9/2008 | Melanson |
| 2008/0253125 | A1 | 10/2008 | Kang et al. |
| 2008/0258631 | A1 | 10/2008 | Wu et al. |
| 2008/0258647 | A1 | 10/2008 | Scianna |
| 2008/0278092 | A1 | 11/2008 | Lys et al. |
| 2008/0285257 | A1 | 11/2008 | King |
| 2008/0285266 | A1 | 11/2008 | Thomas |
| 2008/0290814 | A1 | 11/2008 | Leong et al. |
| 2008/0291675 | A1 | 11/2008 | Lin et al. |
| 2008/0298080 | A1 | 12/2008 | Wu et al. |
| 2008/0310119 | A1 | 12/2008 | Giacoma |
| 2008/0315773 | A1 | 12/2008 | Pang |
| 2008/0315784 | A1 | 12/2008 | Tseng |
| 2009/0002995 | A1 | 1/2009 | Lee et al. |
| 2009/0010022 | A1 | 1/2009 | Tsai |
| 2009/0016063 | A1 | 1/2009 | Hu |
| 2009/0021140 | A1 | 1/2009 | Takasu et al. |
| 2009/0046473 | A1 | 2/2009 | Tsai et al. |
| 2009/0052186 | A1 | 2/2009 | Xue |
| 2009/0059557 | A1 | 3/2009 | Tanaka |
| 2009/0059559 | A1 | 3/2009 | Pabst et al. |
| 2009/0059603 | A1 | 3/2009 | Recker et al. |
| 2009/0067170 | A1 | 3/2009 | Bloeman et al. |
| 2009/0067182 | A1 | 3/2009 | Hsu et al. |
| 2009/0073693 | A1 | 3/2009 | Nall et al. |
| 2009/0085500 | A1 | 4/2009 | Zampini, II et al. |
| 2009/0086492 | A1 | 4/2009 | Meyer |

(56) References Cited

U.S. PATENT DOCUMENTS

2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0189540 A1 7/2009 Huang et al.
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1* 11/2009 Ivey et al. ..... 362/219
2009/0295776 A1 12/2009 Yu et al.
2009/0296381 A1* 12/2009 Dubord ..... 362/218
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046210 A1 2/2010 Mathai et al.
2010/0046222 A1 2/2010 Yang
2010/0071946 A1 3/2010 Hashimoto
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0177532 A1* 7/2010 Simon et al. ..... 362/555
2010/0181178 A1 7/2010 Chang et al.
2010/0201269 A1 8/2010 Tzou et al.
2010/0207547 A1 8/2010 Koroki et al.
2010/0220469 A1 9/2010 Ivey et al.
2010/0237790 A1 9/2010 Peng
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0309652 A1 12/2010 Shen et al.
2010/0320922 A1 12/2010 Palazzolo et al.
2011/0006658 A1 1/2011 Chan et al.
2011/0090682 A1 4/2011 Zheng et al.
2011/0109454 A1 5/2011 McSheffrey, Sr.
2011/0112661 A1 5/2011 Jung et al.
2011/0141745 A1* 6/2011 Gu et al. ..... 362/311.02
2011/0156584 A1 6/2011 Kim
2011/0176298 A1 7/2011 Meurer et al.
2011/0199723 A1 8/2011 Sato
2011/0199769 A1 8/2011 Bretschneider et al.
2011/0204777 A1 8/2011 Lenk
2011/0280010 A1* 11/2011 Ou et al. ..... 362/217.02
2011/0291588 A1 12/2011 Tagare
2012/0014086 A1 1/2012 Jonsson
2012/0043892 A1 2/2012 Visser et al.
2012/0063140 A1 3/2012 Kong et al.
2012/0080994 A1 4/2012 Chin et al.
2012/0081891 A1 4/2012 Tung et al.
2012/0098439 A1 4/2012 Recker et al.
2012/0106144 A1 5/2012 Chang
2012/0113628 A1 5/2012 Burrow et al.
2012/0127726 A1 5/2012 Yen
2012/0146503 A1 6/2012 Negley et al.
2012/0147597 A1 6/2012 Farmer
2012/0153865 A1 6/2012 Rolfes et al.
2012/0155073 A1 6/2012 McCanless et al.
2012/0161666 A1 6/2012 Antony et al.
2012/0194086 A1 8/2012 Liu et al.
2012/0195032 A1 8/2012 Shew
2012/0212951 A1 8/2012 Lai et al.
2012/0212953 A1 8/2012 Bloom et al.
2012/0230044 A1 9/2012 Zhang et al.
2012/0236533 A1 9/2012 Nakamura et al.
2012/0236554 A1 9/2012 Rust
2012/0243216 A1 9/2012 Lai et al.
2012/0243217 A1 9/2012 Szprengiel et al.
2012/0274214 A1 11/2012 Radermacher et al.
2012/0275154 A1 11/2012 Hood et al.
2012/0293991 A1 11/2012 Lin
2012/0293996 A1 11/2012 Thomas et al.
2012/0300445 A1 11/2012 Chu et al.
2012/0300468 A1 11/2012 Chang et al.
2012/0300486 A1 11/2012 Matsushita et al.
2012/0307524 A1 12/2012 Schapira et al.
2012/0320598 A1 12/2012 Son
2013/0039051 A1 2/2013 Wu
2013/0044471 A1 2/2013 Chen
2013/0044476 A1 2/2013 Bretschneider et al.
2013/0050997 A1 2/2013 Bretschneider et al.
2013/0050998 A1 2/2013 Chu et al.
2013/0057146 A1 3/2013 Chao
2013/0058079 A1 3/2013 Dellian et al.
2013/0063944 A1 3/2013 Lodhie et al.
2013/0077297 A1 3/2013 Wu et al.
2013/0094200 A1 4/2013 Dellian et al.
2013/0148349 A1 6/2013 Pasqualini et al.
2013/0200797 A1 8/2013 Timmermans et al.
2013/0201690 A1 8/2013 Vissenberg et al.
2013/0206597 A1 8/2013 Wang et al.
2013/0221867 A1 8/2013 Deppe et al.
2013/0242553 A1 9/2013 Feng et al.
2013/0250610 A1 9/2013 Brick et al.
2013/0258668 A1 10/2013 Dellian et al.

FOREIGN PATENT DOCUMENTS

CN 2869556 Y 2/2007
CN 101016976 A 8/2007
CN 101075605 A 11/2007
CN 201129681 Y 10/2008
CN 201184574 Y 1/2009
CN 101737664 A1 6/2010
DE 19651140 A1 6/1997
DE 19624087 A1 12/1997
DE 29819966 U1 3/1999
DE 29900320 U1 5/1999
DE 29817609 U1 1/2000
DE 20018865 U1 2/2001
EP 0013782 B1 3/1983
EP 0091172 A2 10/1983
EP 0124924 B1 9/1987
EP 0174699 B1 11/1988
EP 0197602 B1 11/1990
EP 0214701 B1 3/1992
EP 0262713 B1 6/1992
EP 0203668 B1 2/1993
EP 0272749 B1 8/1993
EP 0337567 B1 11/1993
EP 0390262 B1 12/1993
EP 0359329 B1 3/1994
EP 0403011 B1 4/1994
EP 0632511 1/1995
EP 0432848 B1 4/1995
EP 0659531 A1 6/1995
EP 0403001 B1 8/1995
EP 0525876 5/1996
EP 0714556 1/1999
EP 0889283 A1 7/1999
EP 0458408 B1 9/1999

(56) References Cited

FOREIGN PATENT DOCUMENTS

| | | | |
|---|---|---|---|
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2333407 | A1 | 6/2011 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| GB | 2495647 | A | 4/2013 |
| JP | S68248271A | A | 10/1987 |
| JP | 06-054289 | | 2/1994 |
| JP | H6-54103 | U | 7/1994 |
| JP | 07-249467 | | 9/1995 |
| JP | 7264036 | | 10/1995 |
| JP | 08-162677 | A | 6/1996 |
| JP | H11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2010-15754 | | 1/2010 |
| JP | 2010-192229 | A1 | 9/2010 |
| JP | 2010-205553 | A | 9/2010 |
| JP | 5102530 | B2 | 12/2012 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | WO9906759 | A1 | 2/1999 |
| WO | WO9910867 | A1 | 3/1999 |
| WO | WO9931560 | A2 | 6/1999 |
| WO | WO9945312 | A1 | 9/1999 |
| WO | WO9957945 | A1 | 11/1999 |
| WO | WO0001067 | A2 | 1/2000 |
| WO | WO0225842 | A2 | 3/2002 |
| WO | WO02061330 | A2 | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |
| WO | WO03026358 | A1 | 3/2003 |
| WO | WO03055273 | A2 | 7/2003 |
| WO | WO03067934 | A2 | 8/2003 |
| WO | WO03090890 | A1 | 11/2003 |
| WO | WO03096761 | A1 | 11/2003 |
| WO | WO2004021747 | A2 | 3/2004 |
| WO | WO2004023850 | A2 | 3/2004 |
| WO | WO2004032572 | A2 | 4/2004 |
| WO | WO2004057924 | A1 | 7/2004 |
| WO | WO2004100624 | A2 | 11/2004 |
| WO | WO2005031860 | A2 | 4/2005 |
| WO | WO2005052751 | A2 | 6/2005 |
| WO | WO2005060309 | A2 | 6/2005 |
| WO | WO2005116519 | A1 | 8/2005 |
| WO | WO2005084339 | A2 | 9/2005 |
| WO | WO2005089293 | A2 | 9/2005 |
| WO | WO2005089309 | A2 | 9/2005 |
| WO | WO2005103555 | A1 | 11/2005 |
| WO | WO2006023149 | A2 | 3/2006 |
| WO | WO2006044328 | A1 | 4/2006 |
| WO | WO2006046207 | A1 | 5/2006 |
| WO | WO2006056120 | A1 | 6/2006 |
| WO | WO2006093889 | A2 | 9/2006 |
| WO | WO2006095315 | | 9/2006 |
| WO | WO2006095316 | | 9/2006 |
| WO | WO2006127666 | A2 | 11/2006 |
| WO | WO2006127785 | A2 | 11/2006 |
| WO | WO2006133272 | A2 | 12/2006 |
| WO | WO2006137686 | A1 | 12/2006 |

(56) References Cited

FOREIGN PATENT DOCUMENTS

| | | | |
|---|---|---|---|
| WO | WO2007004679 | A1 | 1/2007 |
| WO | WO2007081674 | A1 | 7/2007 |
| WO | WO2007090292 | A1 | 8/2007 |
| WO | WO2007094810 | A2 | 8/2007 |
| WO | WO2008018002 | A2 | 2/2008 |
| WO | WO2008027093 | A2 | 3/2008 |
| WO | WO2008061991 | A1 | 5/2008 |
| WO | WO2008110978 | A1 | 9/2008 |
| WO | WO2008129488 | | 10/2008 |
| WO | WO2008137460 | | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A2 | 4/2010 |
| WO | WO2010047898 | A2 | 4/2010 |
| WO | WO2010047973 | A2 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | | 1/2011 |
| WO | WO2011005579 | A2 | 1/2011 |
| WO | WO2011021719 | A1 | 2/2011 |
| WO | WO2011072308 | A1 | 6/2011 |
| WO | WO2011074884 | A2 | 6/2011 |
| WO | WO2011113709 | A1 | 9/2011 |
| WO | WO2011117059 | A1 | 9/2011 |
| WO | WO2011159436 | A2 | 12/2011 |
| WO | WO2012001584 | A1 | 1/2012 |
| WO | WO2012004708 | A2 | 1/2012 |
| WO | WO2012007899 | A1 | 1/2012 |
| WO | WO2012019535 | A1 | 2/2012 |
| WO | WO2012025626 | A1 | 3/2012 |
| WO | WO2012063174 | A2 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | WO2013097823 | A1 | 7/2013 |
| WO | WO2013098700 | A1 | 7/2013 |
| WO | WO2013113548 | A1 | 8/2013 |
| WO | WO2013113661 | A1 | 8/2013 |
| WO | WO2013121347 | A1 | 8/2013 |
| WO | WO2013132383 | A1 | 9/2013 |
| WO | WO2013135527 | A1 | 9/2013 |
| WO | WO2013156905 | A1 | 10/2013 |
| WO | WO2013167419 | A1 | 11/2013 |

OTHER PUBLICATIONS

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

D.N.A.-III, [online], [retrieved Mar. 10, 2009] Retrieved from the PLC Lighting Web Page using Internet <URL: http://www.plclighting.com/product_info.php?cPath=1&products_id=92>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.

E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.

E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.

Extended European Search Report for co-pending European Application No. 10 73 2124 mailed on Dec. 13, 2012 in 8 pages.

Extended European Search Report for co-pending European Application No. 09822425.6 mailed on Aug. 30, 2012 in 9 pages.

Extended European Search Report for co-pending European Application No. 10797596.3 mailed on Jan. 17, 2013 in 11pages.

Extended European Search Report for co-pending European Application No. 10736237.8 mailed on Oct. 19, 2012 in 5 pages.

Extended European Search Report for co-pending European Application No. 10738925.6 mailed on Oct. 1, 2012 in 7 pages.

Extended European Search Report for co-pending European Application No. 11760309 mailed on Sep. 30, 2013 in 7 pages.

Examination and Search Report mailed on Jul. 2, 2012 in cooresponding United Kingdom Application No. 1018896.9 in 4 pages.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Hightower et al, "A Survey and Taxonomy of Location Systems for Ubiquitous Computing", University of Washington, Computer Science and Engineering, Technical Report UW-CSE Jan. 8, 2003, IEEE, Aug. 24, 2001 in 29 pages.

International Search Report and Written Opinion dated Jan. 4, 2010 from the corresponding International Application No. PCT/US2009/044313 filed May 18, 2009.

International Search Report and Written Opinion dated Feb. 7, 2011 from the corresponding International Application No. PCT/US2010/039678 filed Jun. 23, 2010.

International Search Report and Written Opinion dated May 7, 2010 from the corresponding International Application No. PCT/US2009/057109 filed on Sep. 16, 2009.

International Search Report and Written Opinion dated Apr. 8, 2010 from the corresponding International Application No. PCT/2009/055114 filed on Aug. 27, 2009.

International Search Report and Written Opinion dated Feb. 8, 2011 from the corresponding International Application No. PCT/US2010/039608 filed Jun. 23, 2010.

International Search Report and Written Opinion dated Dec. 13, 2010 from the corresponding International Application No. PCT/US2010/037006 filed Jun. 2, 2010.

International Search Report and Written Opinion dated Mar. 13, 2012 from the corresponding International Application No. PCT/US2011/052995 filed on Sep. 23, 2011.

International Search Report and Written Opinion dated May 14, 2010 from the corresponding International Application No. PCT/US2009/060085 filed Oct. 9, 2009.

International Search Report and Written Opinion dated Aug. 16, 2010 from the corresponding International Application No. PCT/US2010/021131 filed on Jan. 15, 2010.

(56) References Cited

OTHER PUBLICATIONS

International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
International Search Report and Written Opinion dated May 24, 2010 from the corresponding International Application No. PCT/US2009/060087 filed Oct. 9, 2009.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009.
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Feb. 6, 2012 from the corresponding International Application No. PCT/US2011/043524 filed on Jul. 11, 2011.
International Search Report and Written Opinion dated Feb. 15, 2013 from the corresponding International Application No. PCT/US22012/052244 filed on Aug. 24, 2012.
International Search Report and Written Opinion dated Aug. 30, 2011 for the corresponding International Application No. PCT/US2011/029994 filed Mar. 25, 2011.
International Search Report and Written Opinion dated Aug. 13, 2013 for the corresponding International Application No. PCT/US2013/028669 filed Mar. 1, 2013.
International Search Report and Written Opinion dated Sep. 23, 2013 for the corresponding International Application No. PCT/US2013/049432 filed Jul. 5, 2013.
International Search Report and Written Opinion dated Oct. 10, 2013 for the corresponding International Application No. PCT/US2013/049427 filed Jul. 5, 2013.
Notification of Transmittal, the International Search Report and the Written Opinion of the International Searching Authority dated May 7, 2012, from the corresponding International Application No. PCT/US2011/064151.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
Ledtronics, Ledtronics Catalog, 1996, p. 10, Ledtronics, Torrance, California.
Phason Electronic Control Systems, Light Level Controller (LLC) case study. Nov. 30, 2004. 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.
PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.
Saha et al, "Location Determination of a Mobile Device using IEEE 802.11 Access Point Signals", May 5, 2002 in 20 pages.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_1000000000000056772>.
Supplementary European Search Report for corresponding European Application No. 10797603.7 mailed Aug. 5, 2013 in 5 pages.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

(56) References Cited

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

Notification of Transmittal, the International Search Report and the Written Opinion of the International Searching Authority dated May 7, 2012 from the corresponding International Application No. PCT/US2011/058312.

Bose, "Modern Power Electronics, Evolution, Technology and Applications", 1992, IEEE Press, pp. 14-15.

Kularatna, "Power Electronics Design Handbook, Low-power Components and Applications", 1998, Newns, pp. 71-75.

Lighting Handbook, 8th Edition, Illuminating Engineering Society of North America, 1993, pp. 237-240.

Hodapp, "Chapter 6: Applications for High-Brightness Light-Emitting Diodes", Hodapp, Academic Press, 1997, pp. 334-336, "High Brightness Light Emitting Diodes", Stringfellow et al., volume editors.

* cited by examiner

DIFFUSERS FOR LED-BASED LIGHTS

CROSS REFERENCE TO RELATED APPLICATIONS

This application claims priority to U.S. Provisional Patent Application No. 61/783,217 filed Mar. 14, 2013 and U.S. Provisional Patent Application No. 61/846,712 filed Jul. 16, 2013, the entire contents of which are incorporated herein by reference.

TECHNICAL FIELD

This disclosure relates to light emitting diode (LED)-based lights for replacing conventional lights in standard light fixtures and more particularly to diffusers for such lights.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years. LED-based lights have also been developed for use as replacements for incandescent bulbs.

SUMMARY

Disclosed herein are a system, method and apparatus for diffusing the light of an LED-based light that includes a lens by affixing a second lens to the LED-based light. In one aspect, an LED-based light assembly comprises a plurality of LEDs; an elongate housing for the LEDs, the housing having an outer surface at least partially defined by a first lens; a second lens, the second lens removably attachable to the outer surface of the housing such that at least a portion of the second lens overlays the first lens in a spaced relationship; and at least one connector arranged at an end of the housing, the connector configured for engagement with a socket of a fluorescent light fixture.

In another aspect, a method of modifying the light diffusion characteristics of an LED-based light with a plurality of LEDs, an elongate housing for the LEDs having an outer surface at least partially defined by a first lens, and at least one connector arranged at an end of the housing configured for engagement with a socket of a fluorescent light fixture comprises removably attaching a second lens to the outer surface of the housing, such that at least a portion of the second lens overlays the first lens in a spaced relationship.

In yet another aspect, an LED-based light assembly comprises a plurality of LEDs; an elongate housing for the LEDs, the housing having an outer surface at least partially defined by a first lens and defining a first groove on a first side of the lens and a second groove on an opposing side of the lens, with the first groove bordered by a first edge of the outer surface and the second groove bordered by a second edge of the outer surface; a second lens, the second lens having two opposing end portions and an interior surface extending between the two end portions, with first and second opposing pairs of spaced tabs projecting radially inwardly from the interior surface, wherein the second lens is resiliently flexible such that the second lens is configured to be arranged around the outer surface of the housing in at least one of: a first attachment position, where the first pair of spaced tabs is positioned in the first groove, the second pair of spaced tabs is positioned in the second groove, and at least a portion of the second lens overlays the first lens in a first spaced relationship, or a second attachment position, the first pair of spaced tabs is positioned on both sides of the first edge, the second pair of spaced tabs is positioned on both sides of the second edge, and at least a portion of the second lens overlays the first lens in a second spaced relationship different from the first spaced relationship; and at least one connector arranged at an end of the housing, the connector configured for engagement with a socket of a fluorescent light fixture.

Variations in these and other aspects of this disclosure will be described in additional detail hereafter.

BRIEF DESCRIPTION OF THE DRAWINGS

The various features, advantages and other uses of the present system and method will become more apparent by referring to the following detailed description and drawings in which.

DETAILED DESCRIPTION

Figure 1:
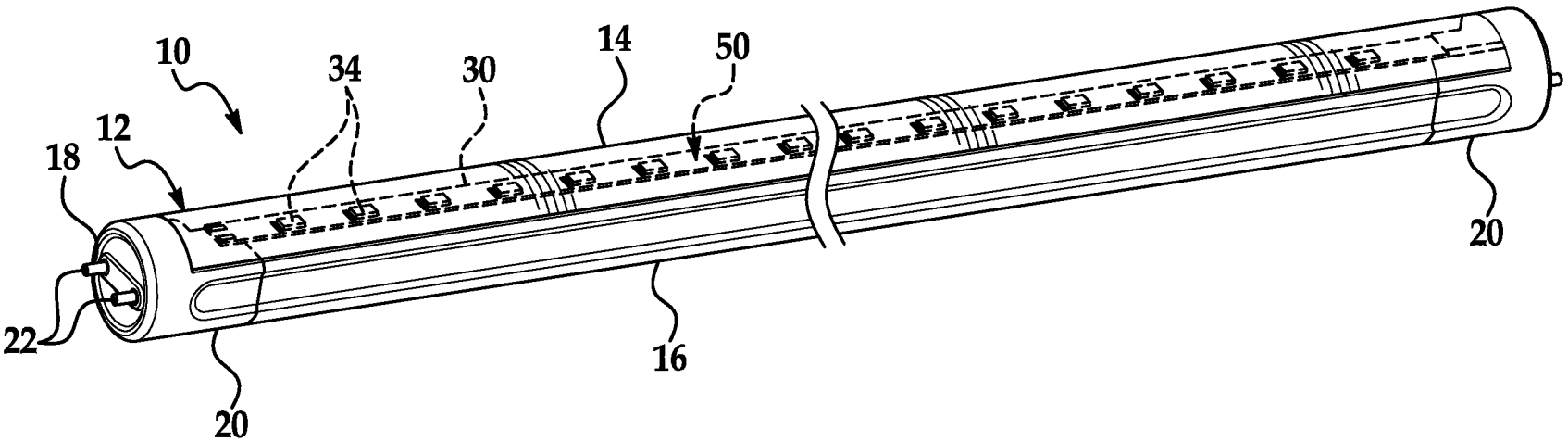
FIG. 1 is a perspective view of an example of an LED-based light.
Figure 2:
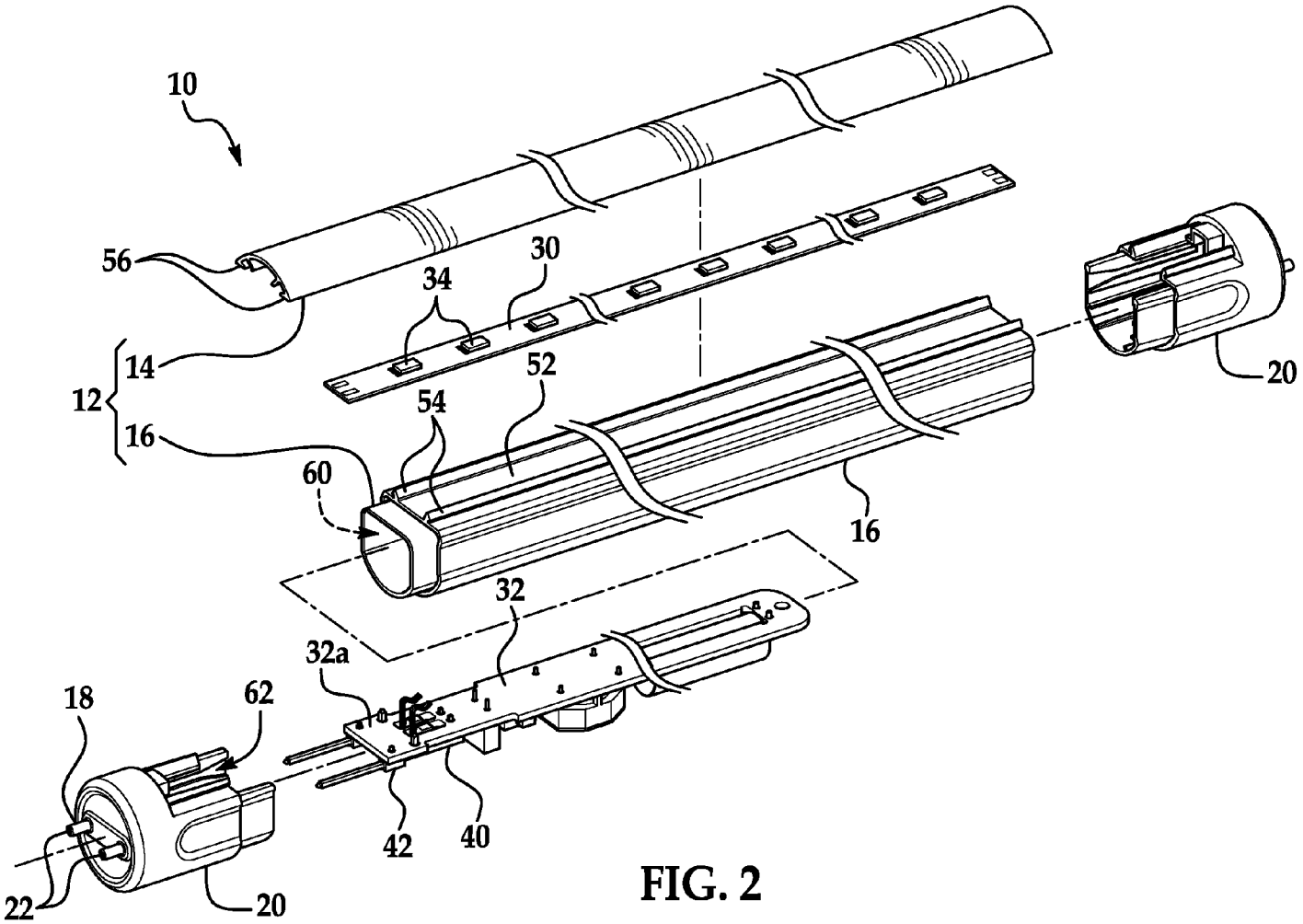
FIG. 2 is a perspective assembly view of the LED-based light of FIG. 1 showing a housing including a lower portion and a lens, an LED circuit board, a power supply circuit board and a pair of end caps.

FIGS. 1 and 2 illustrate an LED-based light 10 for replacing a conventional light in a standard light fixture. LED-based light 10 includes a housing 12 and has a pair of end caps 20 positioned at the ends of housing 12. An LED circuit board 30 including LEDs 34 and a power supply circuit board 32 are arranged within housing 12.

Housing 12 can generally define a single package sized for use in a standard fluorescent light fixture. In the illustrated example, the pair of end caps 20 is attached at opposing longitudinal ends of housing 12 for physically connecting LED-based light 10 to a light fixture. As shown, each end cap 20 carries an electrical connector 18 configured to physically connect to the light fixture. Electrical connectors 18 can be the sole physical connection between LED-based light 10 and the light fixture. One example of a light fixture for the LED-based light 10 is a troffer designed to accept conventional fluorescent lights, such as T5, T8 or T12 fluorescent tube lights. These and other light fixtures for LED-based light 10 can include one or more sockets adapted for physical engagement with electrical connectors 18. Each of the illustrated electrical connectors 18 is a bi-pin connector including two pins 22. Bi-pin electrical connectors 18 are compatible with many fluorescent light fixtures and sockets, although other types of electrical connectors can be used, such as a single pin connector or a screw type connector.

The light fixture for LED-based light 10 can connect to a power source, and at least one of electrical connectors 18 can additionally electrically connect LED-based light 10 to the light fixture to provide power to LED-based light 10. In this example, each electrical connector 18 can include two pins 22, although two of the total four pins can be "dummy pins" that provide physical but not electrical connection to the light fixture. The light fixture can optionally include a ballast for electrical connection between the power source and LED-based light 10.

While the illustrated housing 12 is cylindrical, a housing having a square, triangular, polygonal, or other cross-sectional shape can alternatively be used. Similarly, while the illustrated housing 12 is linear, housings having an alternative shape, e.g., a U-shape or a circular shape can alternatively be used. LED-based light 10 can have any suitable length. For example, LED-based light 10 may be approximately 48" long, and housing 12 can have a 0.625", 1.0" or 1.5" diameter for engagement with a standard fluorescent light fixture.

Housing 12 can be formed by attaching multiple individual parts, not all of which need be light transmitting. For example, the illustrated example of housing 12 is formed in part by attaching a lens 14 at least partially defining housing 12 to an opaque lower portion 16. The illustrated housing 12 has a generally bipartite configuration defining a first cavity 50 between lower portion 16 and lens 14 sized and shaped for housing LED circuit board 30 and a second cavity 60 defined by lower portion 16 sized and shaped for housing power supply circuit board 32.

As shown, the lower portion 16 defines an LED mounting surface 52 for supporting LED circuit board 30. LED mounting surface 52 can be substantially flat, so as to support a flat underside of LED circuit board 30 opposite the LEDs 34. After attachment of lens 14 to lower portion 16 during assembly of LED-based light 10, LED circuit board 30 is positioned within first cavity 50 and adjacent lens 14, such that LEDs 34 of LED circuit board 30 are oriented to illuminate lens 14.

The illustrated lower portion 16 has a tubular construction to define second cavity 60, although lower portion 16 could be otherwise configured to define a cavity configured for housing power supply circuit board 32. LED-based light 10 can include features for supporting power supply circuit board 32 within second cavity 60. For example, as shown, an end cap 20 may include channels 62 configured to slidably receive outboard portions of an end 32*a* of power supply circuit board 32. It will be understood that channels 62 are provided as a non-limiting example and that power supply circuit board 32 may be otherwise and/or additionally supported within second cavity 60.

Lower portion 16 may be constructed from a thermally conductive material and configured as a heat sink to enhance dissipation of heat generated by LEDs 34 during operation to an ambient environment surrounding LED-based light 10. In exemplary LED-based light 10, an LED mounting surface 52 of lower portion 16 is thermally coupled to LEDs 34 through LED circuit board 30, and the remainder of lower portion 16 defines a heat transfer path from LED mounting surface 52 to the ambient environment.

Lower portion 16 and lens 14 may each include complementary structures permitting for attachment of lens 14 to lower portion 16 to define first cavity 50. For example, as shown, lower portion 16 may include a pair of hooked projections 54 for retaining a corresponding pair of projections 56 of lens 14. Projections 56 of lens 14 can be slidably engaged with hooked projections 54 of lower portion 16, or can be snap fit to hooked projections 54. Hooked projections 54 can be formed integrally with lower portion 16 by, for example, extruding lower portion 16 to include hooked projections 54. Similarly, projections 56 can be formed integrally with lens 14 by, for example, extruding lens 14 to include projections 56. Hooked projections 54 and projections 56 can extend the longitudinal lengths of lower portion 16 and lens 14, respectively, although a number of discrete hooked projections 54 and/or projections 56 could be used to couple lens 14 to lower portion 16. Alternatively, lower portion 16 could be otherwise configured for attachment with lens 14. For example, lens 14 could be clipped, adhered, snap- or friction-fit, screwed or otherwise attached to lower portion 16.

Alternatively to the illustrated housing 12, housing 12 can include a light transmitting tube at least partially defined by lens 14. Lens 14 can be made from polycarbonate, acrylic, glass or other light transmitting material (i.e., lens 14 can be transparent or translucent). The term "lens" as used herein means a light transmitting structure, and not necessarily a structure for concentrating or diverging light.

LED-based light 10 can include features for distributing the light produced by LEDs 34 to, for example, emulate in full or in part the uniform light distribution of a conventional fluorescent light. For instance, lens 14 can be manufactured to include light diffusing structures, such as ridges, dots, bumps, dimples or other uneven surfaces formed on an interior or exterior of lens 14. The light diffusing structures can be formed integrally with lens 14, for example, by molding or extruding, or the structures can be formed in a separate manufacturing step such as surface roughening. Alternatively, the material from which lens 14 is formed can include light refracting particles. For example, lens 14 can be made from a composite, such as polycarbonate, with particles of a light refracting material interspersed in the polycarbonate. In addition to or as an alternative to these light diffusing structures, a light diffusing film can be applied to the exterior of lens 14 or placed in housing 12.

LED-based light 10 can include other features for distributing light produced by LEDs 34. For example, lens 14 can be manufactured with structures to collimate light produced by LEDs 34. The light collimating structures can be formed integrally with lens 14, for example, or can be formed in a separate manufacturing step. In addition to or as an alternative to manufacturing lens 14 to include light collimating structures, a light collimating film can be applied to the exterior of lens 14 or placed in housing 12.

In yet other embodiments, LEDs 34 can be over molded or otherwise encapsulated with light transmitting material configured to distribute light produced by LEDs 34. For example, the light transmitting material can be configured to diffuse, refract, collimate and/or otherwise distribute the light produced by LEDs 34. Over molded LEDs 34 can be used alone to achieve a desired light distribution for LED-based light 10, or can be implemented in combination with lens 14 and/or films described above.

The above described or other light distributing features can be implemented uniformly or non-uniformly along a length and/or circumference of the LED-based light 10. These features are provided as non-limiting examples, and in other embodiments, the LED-based light 10 may not include any light distributing features.

LED circuit board 30 can include at least one LED 34, a plurality of series-connected or parallel-connected LEDs 34, an array of LEDs 34 or any other arrangement of LEDs 34.

Each of the illustrated LEDs 34 can include a single diode or multiple diodes, such as a package of diodes producing light that appears to an ordinary observer as coming from a single source. LEDs 34 can be surface-mount devices of a type available from Nichia, although other types of LEDs can alternatively be used. For example, LED-based light 10 can include high-brightness semiconductor LEDs, organic light emitting diodes (OLEDs), semiconductor dies that produce light in response to current, light emitting polymers, electroluminescent strips (EL) or the like. LEDs 34 can emit white light. However, LEDs that emit blue light, ultra-violet light or other wavelengths of light can be used in place of or in combination with white light emitting LEDs 34.

The orientation, number and spacing of LEDs 34 can be a function of a length of LED-based light 10, a desired lumen output of LED-based light 10, the wattage of LEDs 34, a desired light distribution for LED-based light 10 and/or the viewing angle of LEDs 34.

LEDs 34 can be fixedly or variably oriented in LED-based light 10 for facing or partially facing an environment to be illuminated when LED-based light 10 is installed in a light fixture. Alternatively, LEDs 34 can be oriented to partially or fully face away from the environment to be illuminated. In this alternative example, LED-based light 10 and/or a light fixture for LED-based light 10 may include features for reflecting or otherwise redirecting the light produced by the LEDs into the environment to be illuminated.

For a 48" LED-based light 10, the number of LEDs 34 may vary from about thirty to sixty such that LED-based light 10 outputs approximately 3,000 lumens. However, a different number of LEDs 34 can alternatively be used, and LED-based light 10 can output any other amount of lumens.

LEDs 34 can be arranged in a single longitudinally extending row along a central portion of LED circuit board 30 as shown, or can be arranged in a plurality of rows or arranged in groups. LEDs 34 can be spaced along LED circuit board 30 and arranged on LED circuit board 30 to substantially fill a space along a length of lens 14 between end caps 20 positioned at opposing longitudinal ends of housing 12. The spacing of LEDs 34 can be determined based on, for example, the light distribution of each LED 34 and the number of LEDs 34. The spacing of LEDs 34 can be chosen so that light output by LEDs 34 is uniform or non-uniform along a length of lens 14. In one implementation, one or more additional LEDs 34 can be located at one or both ends of LED-based light 10 so that an intensity of light output at lens 14 is relatively greater at the one or more ends of LED-based light 10. Alternatively, or in addition to spacing LEDs 34 as described above, LEDs 34 nearer one or both ends of LED-based light 10 can be configured to output relatively more light than the other LEDs 34. For instance, LEDs 34 nearer one or both ends of LED-based light 10 can have a higher light output capacity and/or can be provided with more power during operation.

Power supply circuit board 32 is positioned within housing 12 adjacent electrical connector 18 and has power supply circuitry configured to condition an input power received from, for example, the light fixture through electrical connector 18, to a power usable by and suitable for LEDs 34. In some implementations, power supply circuit board 32 can include one or more of an inrush protection circuit, a surge suppressor circuit, a noise filter circuit, a rectifier circuit, a main filter circuit, a current regulator circuit and a shunt voltage regulator circuit. Power supply circuit board 32 can be suitably designed to receive a wide range of currents and/or voltages from a power source and convert them to a power usable by LEDs 34.

LED-based light 10 may require a number of electrical connections to convey power between the various illustrated spatially distributed electrical assemblies included in LED-based light 10, such as LED circuit board 30, power supply circuit board 32 and electrical connector 18. These connections can be made using a circuit connector header 40 and a pin connector header 42, as shown in FIG. 2. In particular, when LED-based light 10 is assembled, circuit connector header 40 may be arranged to electrically couple LED circuit board 30 to power supply circuit board 32, and pin connector header 42 may be arranged to electrically couple power supply circuit board 32 to pins 22 of an end cap 20.

As shown, LED circuit board 30 the power supply circuit board 32 are vertically opposed and spaced with respect to one another within housing 12. LED circuit board 30 and power supply circuit board 32 can extend a length or a partial length of housing 12, and LED circuit board 30 can have a length different from a length of power supply circuit board 32. For example, LED circuit board 30 can generally extend a substantial length of housing 12, and power supply circuit board 32 can extend a partial length of housing 12. However, it will be understood that LED circuit board 30 and/or power supply circuit board 32 could be alternatively arranged within housing 12, and that LED circuit board 30 and power supply circuit board 32 could be alternatively spaced and/or sized with respect to one another.

LED circuit board 30 and power supply circuit board 32 are illustrated as elongate printed circuit boards. Multiple circuit board sections can be joined by bridge connectors to create LED circuit board 30 and/or power supply circuit board 32. Also, other types of circuit boards may be used, such as a metal core circuit board. Further, the components of LED circuit board 30 and power supply circuit board 32 could be on a single circuit board or more than two circuit boards.

LED-based lights are often used in lighting fixtures that require four or more lighting tubes each. Some lighting fixtures include diffusers, however, in other cases, the lighting fixtures do not include diffusers or include diffusers that were designed for non-LED-based lights, such as fluorescent lights, and may not diffuse light well enough to work with LED-based lights. In these lighting fixtures, the spacing between multiple LED-based lights can create "hot spots" at locations corresponding to the positions of the LED-based lights on production of light by the LEDs. In addition, because the LED-based lights are generally more efficient sources of light compared to the fluorescent lights, it is contemplated that one or more of the total lights in a lighting fixture may be eliminated during a retrofit replacement of fluorescent lights with LED-based lights. This in turn may accentuate the existence and appearance of hot spots. Aspects of disclosed implementations provide diffusors to work with LED-based lights by attaching directly to the light without requiring fasteners or adhesives. These diffusers can be attached to LED-based lights without additional diffusers or in conjunction with existing diffusers.

The diffusers disclosed herein can be attached directly to LED-based lights without any additional fixtures, fasteners or adhesives. The diffusers disclosed herein can be slipped or snapped on to the LED-based light without tools and may be held in place by tabs on the diffuser fitting into a groove or grooves on the LED-based light where friction between the diffuser tabs and the LED-based light keeps the diffuser in place. This is in contrast to diffusers that are manufactured to attach to light fixtures or ceiling panels, for example. Diffusers manufactured to attach to light fixtures or ceiling panels cannot be used to attach directly to an LED-based light because the size, shape and elasticity of these diffusers do not permit them to be attached to the LED-based light and held in position without fasteners or adhesives.

Particularly where LED-based lights are used in lighting fixtures having no diffuser, the teachings herein provide diffusing capability to the LED-based light by providing a diffuser that can be attached to an LED-based light. The diffusers may be attached to an LED-based light without requiring fasteners or adhesives. The diffuser can be attached and detached without tools to permit the diffuser to be removed, for example, from a burned-out light and/or attached to the new replacement light.

The diffusers, although according to the examples may have different cross-sections and sizes, are each sized and shaped to permit the diffuser to be affixed to an LED-based light that already has a lens, a way of maintaining their position on an LED-based light once slid or snapped into place and sufficient surface area to cover the lens so as to diffuse the light being emitted from the LED-based light to which the LED-based light is affixed. In certain embodiments, it is desirable that the diffusers be flexible to permit the diffuser to be deformed while being snap-fit to the LED-based light. In these cases, the diffuser could be removed and exchanged, such as to change the appearance of the emitted light. In other cases, such as where the diffusers are slid on, removal of the LED-based light from its fixture may be required to remove and/or replace the diffuser.

Figure 3:
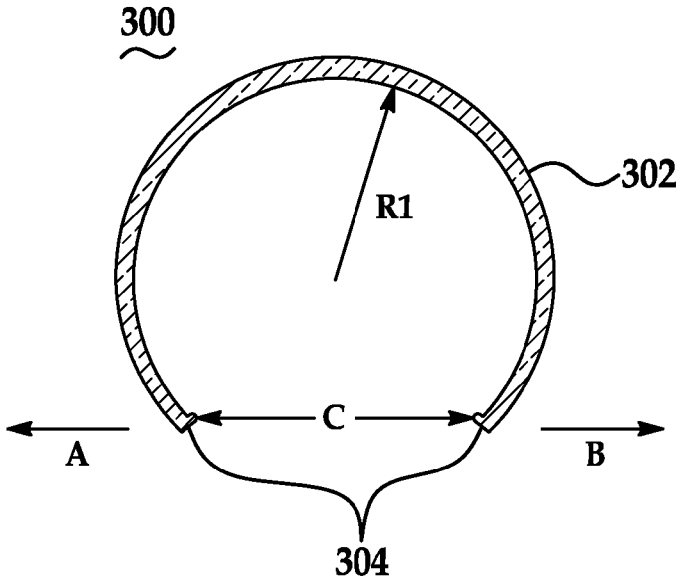
FIG. 3 is a cross-section of an example of a diffuser for the LED-based light in accordance with one disclosed implementation.

FIG. 3 shows a cross-sectional view of a diffuser 300 designed to attach to an LED-based light such as LED-based light 10. Diffuser 300 includes a curved section 302 of diffusing material, which can be opalescent or otherwise frosted translucent plastic material. Diffuser 300 can also be made of plastic material embossed with a pattern that diffuses light. Diffuser 300 has a generally constant curved cross sectional profile with a radius of curvature R1. Diffuser 300 also includes tabs 304 formed at an interior surface of diffuser 300 that can be molded into diffuser 300 to attach diffuser 300 to an LED-based light. As shown, tabs 304 project radially inward from curved section 302 to provide two or more points of attachment to an LED-based light. Diffuser 300 may be made of any suitable plastic or other material having the properties of being transparent or translucent to visible wavelengths of light, flexible enough to snap onto an LED-based light and sturdy enough to provide adequate service life.

Diffuser 300 can have a generally open cross sectional profile and can be manually forced to an open position by bending it open in the direction of the arrows A and B to permit diffuser 300 to be placed over an LED-based light and then released to attach the diffuser 300 to the LED-based light. Once diffuser 300 is bent open in the direction of the arrows A and B and placed over the LED-based light, diffuser 300 can be released to permit tabs 304 to assume their normal position, thereby forming a friction fit to the LED-based light. In a normal position, diffuser 300 is designed so that distance "C" between the tabs 304 is sized to be slightly smaller than the width of the LED-based light, so that when diffuser 300 is released, diffuser 300 will be held onto the LED-based light by the friction between tabs 304 and the LED-based light. When diffuser 300 is assembled with the LED-based light, tabs 304 on diffuser 300 may fit into recesses on the sides of the LED-based light. Diffuser 300 can be manufactured from a resilient material that permits the diffuser to be bent open to permit diffuser 300 to be put into position over the LED-based light and then released to allow the tabs of the diffuser to contact the LED-based light. The dimensions of diffuser 300 are specified to permit diffuser 300 to be bent open to fit into position on the LED-based light and when released hold the LED-based light firmly enough to keep diffuser 300 in position without slipping off or out of position.

Figure 4:
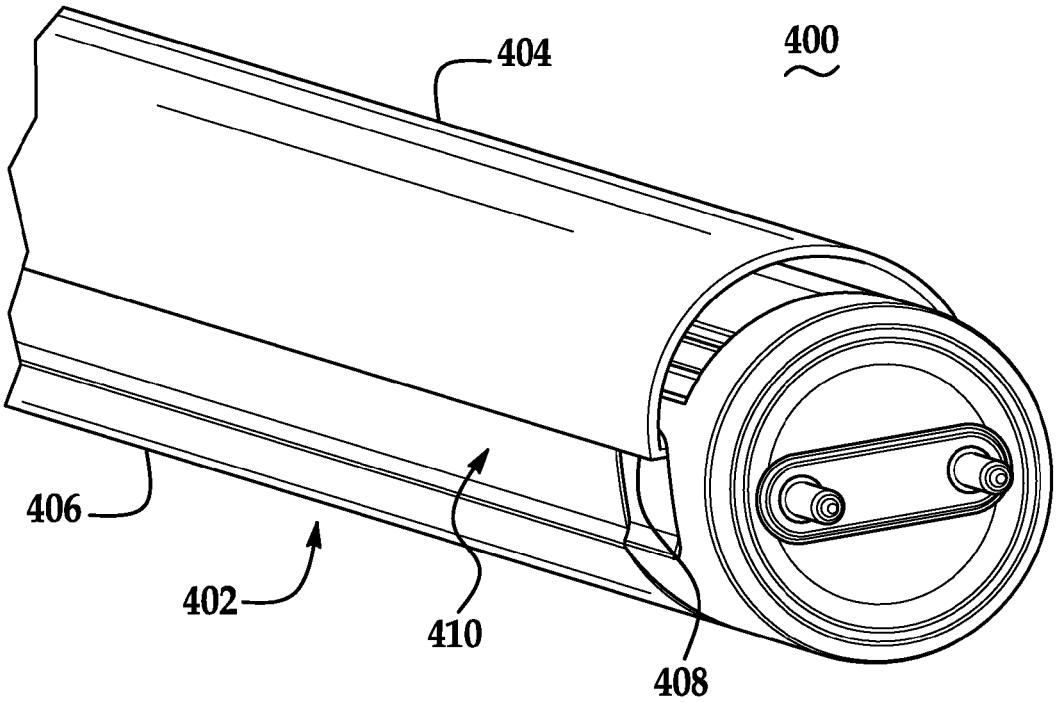
FIG. 4 is a perspective view of the LED-based light with the diffuser in accordance with FIG. 3.

FIG. 4 shows an LED-based light assembly 400 including an LED-based light 402 having a diffuser 404. LED-based light 402 conforms to the configuration of FIGS. 1 and 2 in this example. Diffuser 404 is attached to LED-based light 402 by bending diffuser 404 open to permit tabs 408 of diffuser 404 to be placed over housing 406 and released to fit tabs 408 into a groove 410 in housing 406. The elasticity of the plastic material of which diffuser 404 is made can cause tabs 408 to fit tightly in groove 410 of housing 406 and thereby affix diffuser 404 to LED-based light 402 without using fasteners or adhesive. In this way, diffuser 400 is snap-fit on to LED-based light 402. To remove diffuser 400 from LED-based light 402, diffuser 400 is bent open to permit tabs 408 to be removed from groove 410 in housing 406. In an alternative implementation, diffuser 404 may be slid into groove 410 in whole or in part instead of being snap-fit with groove 410. Light from LEDs of LED-based light assembly 400 pass through the lens and then diffuser 404 to affect the characteristics of the emitted light.

FIGS. 5*a*-5*h* show cross-sectional views of various diffusers that can be used in accordance with the teachings herein. As described above in connection with diffuser 300 shown in FIG. 3, diffusers may be manufactured in various colors and textures, including transparent and translucent colors such as opal. They may also have surface effects and/or coatings as described above with regard to lens 14. It will be understood that these diffusers may also be attached to an LED-based light in a similar manner as that described above for diffuser 300.

Figure 5A:
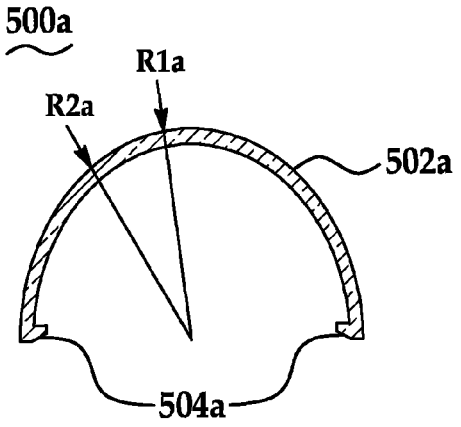
FIGS. 5*a-h* are cross-sectional views of different examples of diffusers for the LED-based light.

FIG. 5*a* shows a diffuser 500*a*. Similarly to diffuser 300, diffuser 500*a* includes a curved section 502*a* of diffusing material. Differently from diffuser 300, curved section 502*a* of diffuser 500*a* is less rounded than curved section 302. In particular, curved section 502*a* of diffuser 500*a* has a slightly elongated curved cross sectional profile, with a radius of curvature R1*a* being larger than radius of curvature R2*a*. Diffuser 500*a* also includes tabs 504*a* that can be molded into diffuser 500*a* to attach diffuser 500*a* to an LED-based light. As shown, tabs 504*a* generally taper to a blunt point as they project radially inward from curved section 502*a*.

Figure 5B:
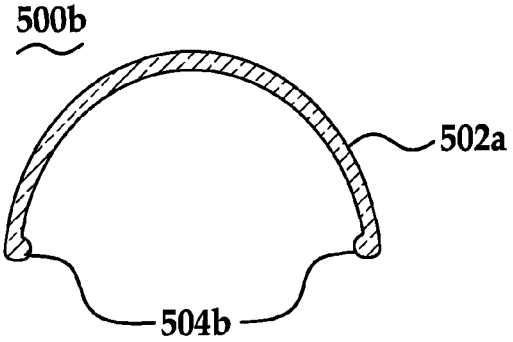
Figure 5C:
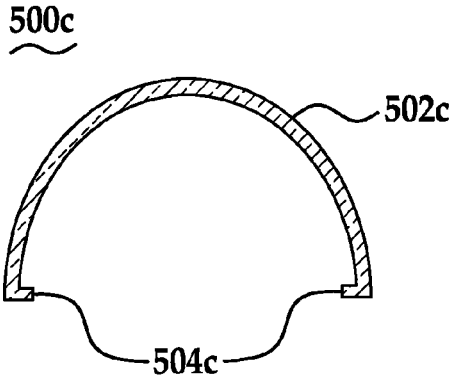

FIG. 5*b* shows a diffuser 500*b*. Diffuser 500*b* is similar to diffuser 500*a* from FIG. 5*a*, with a curved section 502*b* of diffusing material. In diffuser 500*b*, however, tabs 504*b* are generally rounded. FIG. 5*c* shows a diffuser 500*c* that, similarly to diffusers 500*a* and 500*b*, includes a curved section 502*c* of diffusing material. In diffuser 500*c*, however, tabs 504*c* do not taper radially inward as they project radially inward from curved section 502*c* and are not rounded. Instead, as shown, tabs 504*c* have generally straight, parallel opposing walls. In addition, in diffuser 500*c* of FIG. 5*c*, tabs 504*c* are slightly folded under, or angled towards curved section 502*c*, to permit diffuser 500*c* to be securely engaged to an LED-based light.

Figure 5D:
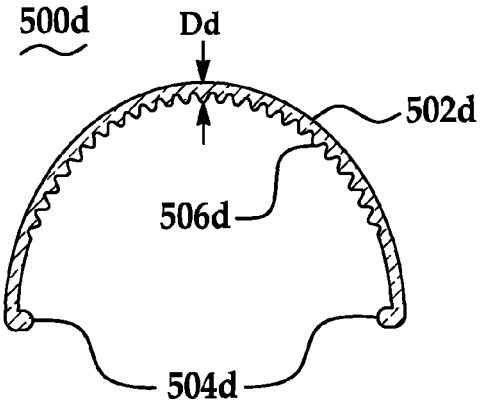
Figure 5E:
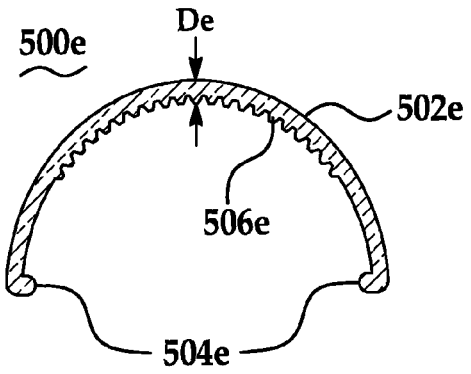
Figure 5F:
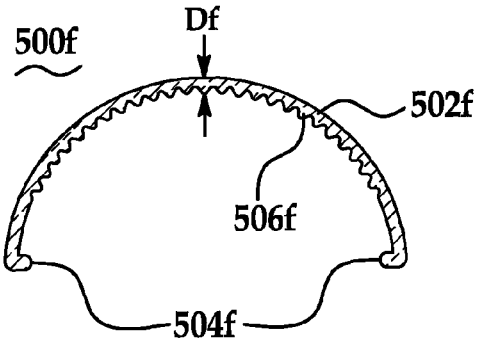

FIGS. 5*d*, 5*e* and 5*f* show examples of diffusers with light diffusing structures molded into an interior surface of the curved section of the diffuser. In the examples, the light diffusing structures are longitudinally extending ridges that may, for example, be formed into the diffusers during an extrusion process. As explained below, the ridges can have different thicknesses, as defined by a distance between the peaks of the ridges and an opposing outer surface of the curved section.

FIG. 5*d* shows a diffuser 500*d*. Diffuser 500*d* is similar to diffuser 500*b* from FIG. 5*b*, with a curved section 502*d* of diffusing material and generally rounded tabs 504*d*. Diffuser

500*d* further includes ridges 506*d* formed on an interior surface of the curved section 502*d*. In diffuser 500*d*, ridges 506*d* have a thickness defined by a distance Dd between the peaks of the ridges 506*d* and an opposing outer surface of curved section 502*d*.

FIG. 5*e* shows a diffuser 500*e*. Diffuser 500*e* is also similar to diffuser 500*b* from FIG. 5*b*, with a curved section 502*e* of diffusing material and generally rounded tabs 504*e*. Diffuser 500*e* further includes ridges 506*e* formed on an interior surface of the curved section 502*e*. In diffuser 500*e*, ridges 506*e* have a thickness defined by a distance De between the peaks of the ridges 506*e* and an opposing outer surface of curved section 502*e*. It can be seen that in diffuser 500*e*, distance De is larger than distance Dd in diffuser 500*d* from FIG. 5*d*.

FIG. 5*f* shows a diffuser 500*f*. Diffuser 500*f* is similar to diffuser 500*b* from FIG. 5*b*, with a curved section 502*f* of diffusing material and generally rounded tabs 504*f*. In diffuser 500*f*, however, the cross sectional profile of curved section 502*f* is slightly shallower than that of curved section 502*b* of diffuser 500*b* from FIG. 5*b*. Diffuser 500*f* further includes ridges 506*f* formed on an interior surface of the curved section 502*f*. In diffuser 500*f*, ridges 506*f* have a thickness defined by a distance Df between the peaks of the ridges 506*f* and an opposing outer surface of curved section 502*f*.

Figure 5G:
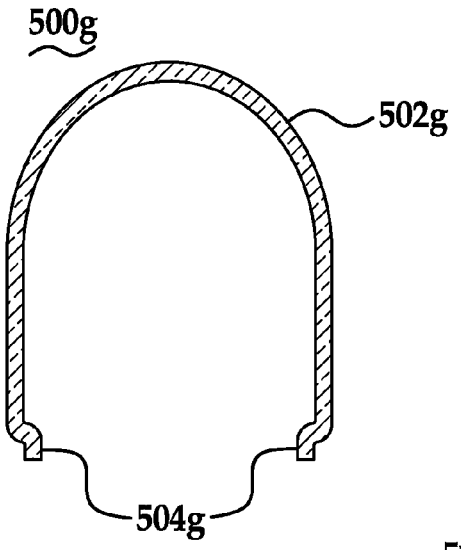

FIG. 5*g* shows a diffuser 500*g* having a curved section 502*g* of diffusing material with a generally elliptical cross sectional profile. Diffuser 500*g* includes tabs 504*g* molded into its base to fit grooves in an LED-based light to prevent diffuser 500*g* from shifting when it is attached to the LED-based light. The overall shape and size of diffuser 500*g* may be such that it encompasses almost an entirety of the surface of a housing of an LED-based light, instead of being arranged to encompass only one portion of the surface, such as to encompass a relatively small lens area. Diffuser 500*g*, therefore, although it may be used with various LED-based light designs, can be particularly useful where the LED-based light has a large lens.

Figure 5H:
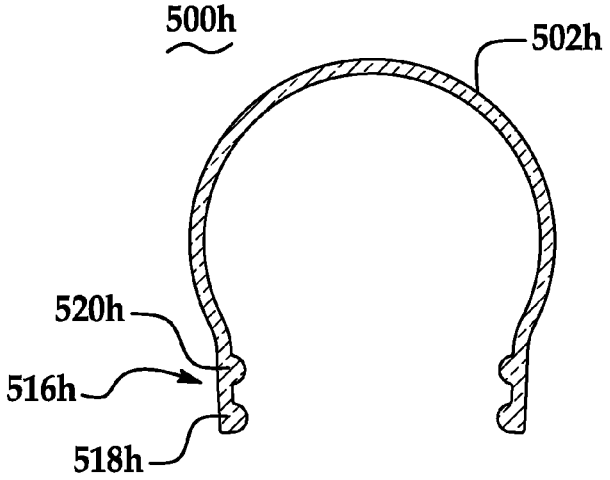

FIG. 5*h* shows a diffuser 500*g* having a curved section 502*g* of diffusing material with a generally elliptical cross sectional profile similarly to diffuser 500*f* in FIG. 5*f*. However, diffuser 500*h* includes end portions 516*h* on each side of diffuser 500*h* having first ribs, or tabs 516*h* and second ribs, or tabs 518*h*. The overall shape and size of diffuser 500*h* may be such that it encompasses almost an entirety of the surface of a housing of an LED-based light, instead of being arranged to encompass only one portion of the surface, such as to encompass a relatively small lens area. Diffuser 500*h*, therefore, although it may be used with various LED-based light designs, can be particularly useful where the LED-based light has a large lens.

Figure 6:
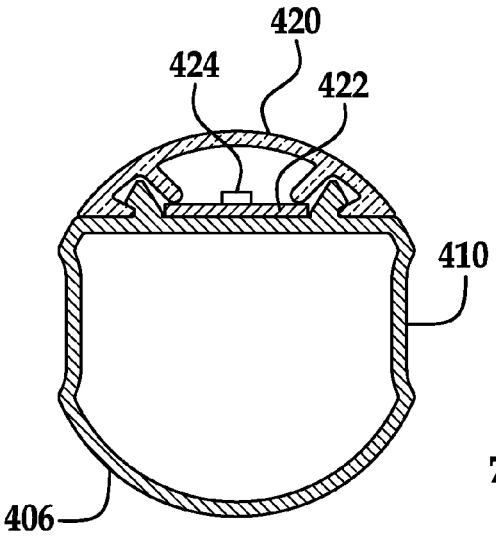
FIG. 6 is a cross-sectional view of the LED-based light.

FIG. 6 shows a cross-section of the LED-based light 402 of FIG. 4 more clearly showing grooves 410 defined at an outer surface of housing 406 that may, in some cases, accept the tabs of a diffuser. A diffuser may be held in place by the friction of tabs against the outer surface of LED-based light 402. In such implementations, the ability of the diffuser to remain in place is a function of the resilience of the diffuser material and the dimensions of the diffuser, which cause the tabs of the diffuser to be held against LED-based light 402 by friction, thereby eliminating the need for fasteners or adhesives to hold the diffuser in place. Fasteners and adhesives may also be omitted when diffusers are slid over all or part of the housing of an LED-based light. Possibly, although less desirably, diffuser may be a closed shape that encompasses the entire surface of LED-based light 402. Note that FIG. 6 also illustrates a circuit board 422 that supports LEDs 424 and extends the length of housing 406. Lens 420 is slid or snap-fit on to housing 406.

Figure 7:
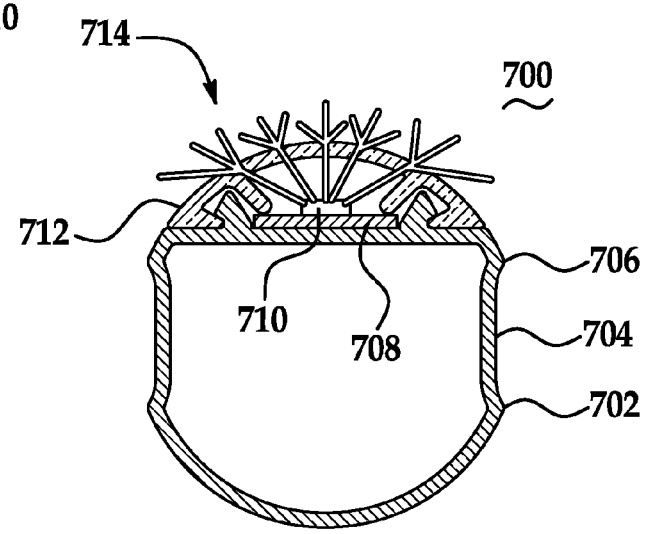
FIG. 7. is a cross-sectional view of the LED-based light with a primary diffuser, showing light rays.

FIG. 7 shows a cross-sectional view of an LED-based light 700 having a built-in primary diffuser or lens 712. LED-based light 700, in this example, has a form similar to that in FIGS. 1 and 2. A housing 702 has a groove 704 on opposing sides and an edge 706 on at least the upper end of groove 704 formed between groove 714 and a remainder of housing 702. LED-based light 700 has a circuit board 708 upon which LEDs 710 are mounted. LEDs 710 emit light, several rays 714 of which are illustrated. Light rays 714 can be emitted by LEDs 710 to pass through primary diffuser 712. Diffuser 712 diffuses light rays 714 passing through it as shown in FIG. 7, thereby diffusing the point-source LED light into a more pleasing diffuse light.

Figure 8:
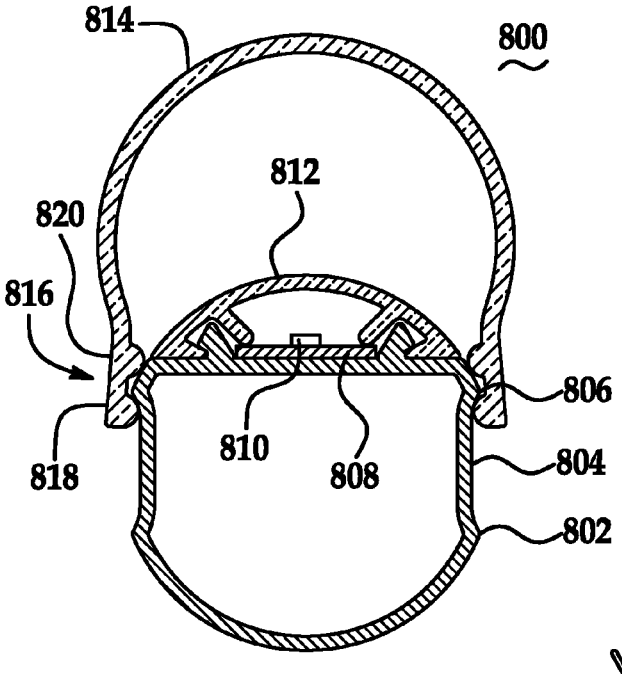
FIG. 8 is a cross-sectional view of the LED-based light with a secondary diffuser in a first position.

FIG. 8 shows an LED-based light 800 having a primary diffuser or lens 812 and a secondary diffuser 814. In this example, LED-base light 800 has a structure similar to that shown in FIG. 7, including a housing 802 with grooves 804 and edges 806 and a circuit board 808 and LEDs 810 that emit light through primary diffuser 812.

In general, in diffusing the light emanating from a light source with an angular spread, such as LEDs 810, a diffusing lens can effectively utilize the extent to which the light emanating from LEDs 810 is already spread, either over space, by a diffuser, or both. Thus, for LEDs 810 with a given spread, the effectiveness of a diffuser in diffusing the light emanating from LEDs 810 of LED-based light 800 is a product of, among other things, the proximity of the diffuser to LEDs 800.

LED-based light 800 also has secondary diffuser 814 having end portions 816 on each side of secondary diffuser 814 having first ribs, or tabs 818 and second ribs, or tabs 820. The radially outward spacing of secondary diffuser 814 with respect to primary diffuser or lens 812 allows for greater diffusion of the light emanating from LEDs 810, as compared, for example, to primary diffuser or lens 812 in illustrated LED-based light 800 or lenses in other LED-based lights that similarly fall along the cross sectional profile of a fluorescent light. Since this is a cross-sectional view, ribs 818, 820 can extend in the direction in and out of the page. Secondary diffuser 814 can be made of a flexible, transparent or translucent material, for example plastic, which can transmit light and maintain sufficient flexibility to permit secondary diffuser 814 to be attached to housing 802 without requiring fasteners or adhesives. The surface of primary diffuser 812 and secondary diffuser 814 can be embossed or molded with features that diffuse light, such as ridges or surface finishes that diffuse light such as frosting.

Secondary diffuser 814 is made having a size such that end portions 816 can be bent slightly outwards permitting first ribs 818 fit over edges 806. When released, secondary diffuser 814 attempts to return to its original dimensions and thereby grips housing 802 with first 818 and second 820 ribs on either side of edges 806. Secondary diffuser 814 stays in position with respect to housing 802 and LEDs 810 through friction between first 818 and second 820 ribs and housing 802.

Figure 9:
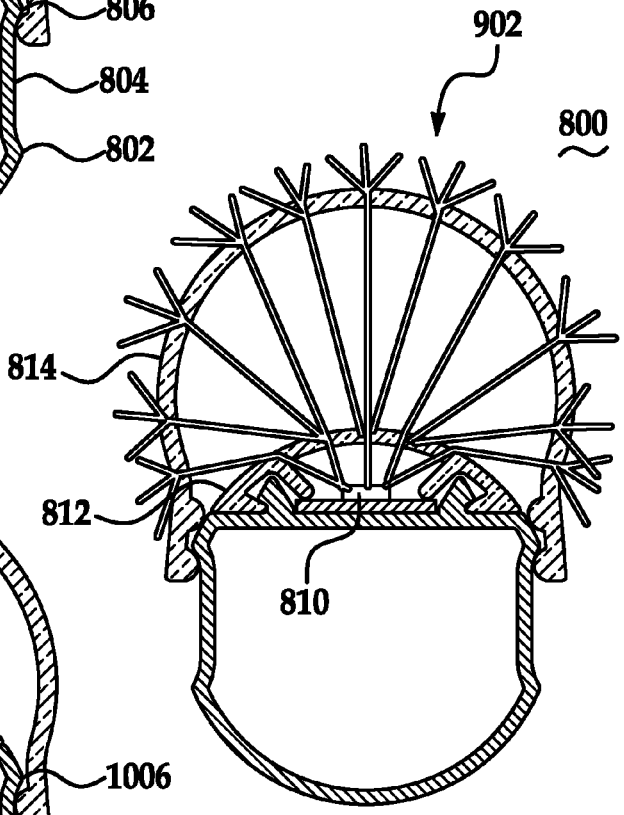
FIG. 9. is a cross-sectional view of the LED-based light with a secondary diffuser in a first position, showing light rays.

FIG. 9 shows LED-based light 800 from FIG. 8 having LEDs 810 that emit light rays 902 that pass through primary diffuser 812 and secondary diffuser 814 before being emitted from LED-based light 800. As can be seen from FIG. 9, light rays 902 from LEDs 810 is diffused by primary diffuser 812 and then further diffused by secondary diffuser 814. Adding secondary diffuser 814 permits LED-based light 800 to emit light more diffusely than is available with only primary diffuser 812 without requiring any additional fixtures or diffusers to be added.

Figure 10:
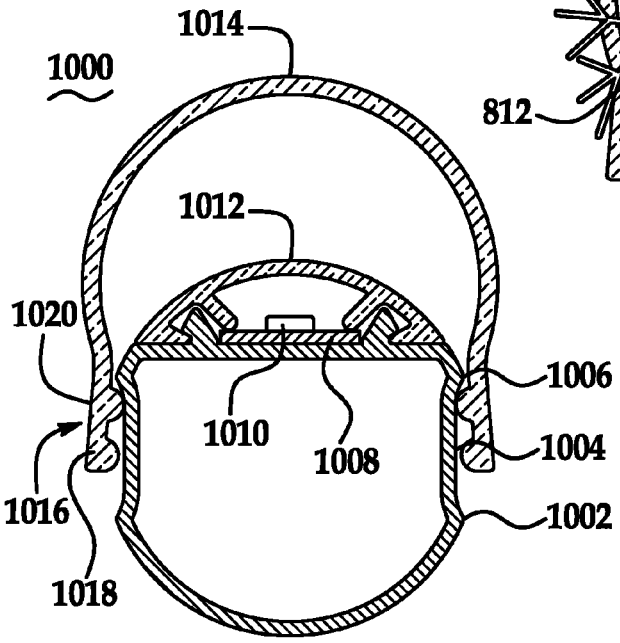
FIG. 10 is a cross-sectional view of the LED-based light with a secondary diffuser in a second position.

FIG. 10 shows an LED-based light 1000 having a primary diffuser 1012 and a secondary diffuser 1014. LED-base light 1000 has a structure similar to that shown in FIG. 7, with a housing 1002 having grooves 1004 and edges 1006 and a circuit board 1008 and LEDs 1010 that emit light through primary diffuser 1012. LED-based light 800 also has secondary diffuser 1014 with end portions 1016 having first ribs 1018 and second ribs 1020. Secondary diffuser 1014 thus has a structure similar to that shown in FIGS. 8 and 9. In this case, end portions 1016 have been bent open to permit first ribs 1018 and second ribs 1020 to fit over edges 1006 of groves 1004 and into grooves 1004. Friction between ribs 1018, 1020 and housing 1002 including grooves 1004 and edges 1006 can prevent secondary diffuser 1014 from moving with respect to LED-based light 1000.

Adjusting a secondary diffuser from the position of diffuser 814 in FIG. 8 to the position of diffuser 1014 in FIG. 10 can change the appearance of the LED-based light. Moving the diffuser closer as shown in FIG. 10 can increase light output over a larger area than the arrangement shown in FIGS. 8 and 9 at the expense, however, of providing somewhat less diffusion. This provides an example in which the light output from the LED-based light can exceed a 180-degree scope, extending backwards significantly to describe an arc of 320 degrees or so, by virtue of the diffuser width exceeding the width of the LED replacement lamp housing.

In some implementations, a secondary diffuser may have surface treatments or other features that change the pattern of light that would otherwise be emitted from the lens of the LED-based light. In other words, the diffuser may be inhomogeneous in reflectivity and/or transmission, instead of providing uniform diffuse light. Changes in the emitted light pattern may be achieved by applying an opaque and/or reflective material to the diffuser by adhesion or by painting or by having a change to one or more sections of the surface of the diffuser itself. In one implementation, portions of the diffusing surface may be covered with an opaque material to block portions of the light being emitted from the LEDs through that portion. For example, a central reflection strip (i.e., one made of a reflective material such as aluminized mylar) may be applied to the length of an interior central portion of the secondary diffuser to prevent light from being emitted directly downwards, thereby making the LED-based light an indirect light source. Similarly, one or more variable internal reflectors may move light around the LED-based light to create a variety of emission patterns. The change in emission pattern may be created by forming one or more sections of the diffuser with a texture that changes the appearance of the emitted light in a localized area of the diffuser. Changes in the emission light pattern may also be achieved by the use of additional optical control films such as multi-layer dielectric reflectors, etc.

While the invention has been described in connection with certain embodiments, it is to be understood that the invention is not to be limited to the disclosed embodiments. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. An LED-based light assembly, comprising:

a plurality of LEDs;

an elongate housing for the LEDs, the housing having an outer surface at least partially defined by a first lens;

a second lens, the second lens removably attachable to the outer surface of the housing such that at least a portion of the second lens overlays the first lens in a spaced relationship; and at least one connector arranged at an end of the housing, the connector configured for engagement with a socket of a fluorescent light fixture, wherein:

the housing defines a groove at the outer surface, the groove bordered by an edge, the second lens includes a pair of spaced tabs projecting radially inwardly from an interior surface of the second lens, the second lens is resiliently flexible and configured to: be manually forced to an open position for arrangement around the outer surface of the housing, to be released for attachment to the outer surface of the housing in a first attachment position with the pair of spaced tabs positioned in the groove, and to be released for attachment to the outer surface of the housing in a second attachment position with the pair of spaced tabs positioned on both sides of the edge.

2. The LED-based light assembly of claim 1, wherein the portion of the second lens for overlaying the first lens is further spaced from the first lens with the second lens released for attachment to the outer surface of the housing in the second attachment position compared to when the second lens is released for attachment to the outer surface of the housing in the first attachment position.

3. The LED-based light assembly of claim 1, wherein the second lens is removably attachable to the outer surface of the housing by a friction fit, without using fasteners or adhesives.

4. The LED-based light assembly of claim 1, wherein the portion of the second lens for overlaying the first lens is translucent.

5. The LED-based light assembly of claim 1, wherein the portion of the second lens for overlaying the first lens includes light diffusing ridges.

6. A method of modifying the light diffusion characteristics of an LED-based light with a plurality of LEDs, an elongate housing for the LEDs having an outer surface at least partially defined by a first lens and defining a groove at the outer surface bordered by an edge, and at least one connector arranged at an end of the housing configured for engagement with a socket of a fluorescent light fixture, the method comprising:

removably attaching a second lens to the outer surface of the housing, such that at least a portion of the second lens overlays the first lens in a spaced relationship, the second lens being resiliently flexible and including a pair of spaced tabs projecting radially inwardly from an interior surface;

forcing the second lens to an open position;

with the second lens in an open position, arranging the second lens at least partially around the outer surface of the housing; and releasing the second lens for attachment to the outer surface of the housing in one of a first attachment position, where the pair of spaced tabs is positioned in the groove, or in a second attachment position, where the pair of spaced tabs is positioned on both sides of the edge.

7. The method of claim 6, further comprising:

removing the second lens from the outer surface of the housing; and removably attaching a third lens to the outer surface of the housing, such that at least a portion of the third lens overlays the first lens in a spaced relationship.

8. The method of claim 6, wherein the portion of the second lens overlaying the first lens is further spaced from the first lens with the second lens released for attachment to the outer surface of the housing in the second attachment position compared to when the second lens is released for attachment to the outer surface of the housing in the first attachment position.

9. The method of claim 6, wherein the removable attachment of the second lens to the outer surface of the housing is by a friction fit, without using fasteners or adhesives.

10. An LED-based light assembly, comprising:

a plurality of LEDs;

an elongate housing for the LEDs, the housing having an outer surface at least partially defined by a first lens and defining a first groove on a first side of the lens and a second groove on an opposing side of the lens, with the first groove bordered by a first edge of the outer surface and the second groove bordered by a second edge of the outer surface;

a second lens, the second lens having two opposing end portions and an interior surface extending between the two end portions, with first and second opposing pairs of spaced tabs projecting radially inwardly from the interior surface, wherein the second lens is resiliently flexible such that the second lens is configured to be arranged around the outer surface of the housing in:

a first attachment position, where the first pair of spaced tabs is positioned in the first groove, the second pair of spaced tabs is positioned in the second groove, and at least a portion of the second lens overlays the first lens in a first spaced relationship, and a second attachment position, the first pair of spaced tabs is positioned on both sides of the first edge, the second pair of spaced tabs is positioned on both sides of the second edge, and at least a portion of the second lens overlays the first lens in a second spaced relationship different from the first spaced relationship; and at least one connector arranged at an end of the housing, the connector configured for engagement with a socket of a fluorescent light fixture.

11. The LED-based light assembly of claim 10, wherein the second lens is removably attachable to the outer surface of the housing by a friction fit in either the first attachment position or the second attachment position, without using fasteners or adhesives.

* * * * *